US006250118B1

(12) United States Patent
Kim

(10) Patent No.: US 6,250,118 B1
(45) Date of Patent: Jun. 26, 2001

(54) WASHING MACHINE HAVING A DEVICE FOR APPLYING A MAGNETIC FIELD TO WATER SUPPLIED INTO A DETERGENT CONTAINER

(75) Inventor: Hak Sil Kim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/245,129

(22) Filed: Jan. 14, 1999

(30) Foreign Application Priority Data

Mar. 4, 1998 (KR) ..... 98-7069
Mar. 6, 1998 (KR) ..... 98-7503

(51) Int. Cl.[7] ..... D06F 39/02
(52) U.S. Cl. ..... 68/17 R; 68/207; 68/13 A
(58) Field of Search ..... 210/222, 695; 134/56 D, 57 D, 58 D; 68/17 R, 207, 13 A

(56) References Cited

U.S. PATENT DOCUMENTS 2,292,814 * 8/1942 Bariffi ..... 68/23.5
3,669,274 * 6/1972 Happ et al. .
3,719,583 * 3/1973 Ustick .
4,167,480 * 9/1979 Mach .
4,892,655 * 1/1990 Makovec .
4,946,590 * 8/1990 Hertzog .
4,959,142 * 9/1990 Dempo .
4,995,425 * 2/1991 Weisenbarger et al. .
5,114,571 * 5/1992 Pier et al. .
5,296,141 * 3/1994 Ellison .
5,364,536 * 11/1994 Mericer .
5,500,121 * 3/1996 Thornton et al. .
5,617,885 * 4/1997 Centis .
5,682,774 * 11/1997 Baumgartner .
5,753,124 * 5/1998 Bogatin et al. .
5,837,143 * 11/1998 Mercier .
5,866,010 * 2/1999 Bogatin et al. .

* cited by examiner

*Primary Examiner*—Frankie L. Stinson
(74) *Attorney, Agent, or Firm*—Burns, Doane, Swecker & Mathis, L.L.P.

(57) ABSTRACT

A washing machine has a container for containing detergent to be supplied into a washing tub and a device for applying a magnetic field to water to be supplied into the detergent container. The device includes a permanent magnet and a magnet casing for accommodating the permanent magnet. A passage part is formed on a central portion of the magnet casing, through which the water to be supplied into the detergent container passes. The magnet takes the shape of a ring surrounding the passage part. When water is supplied into the device, the magnetic field is applied to the water while the water is passing through the passage part, whereby metallic impurities such as calcium ion or magnesium ion are eliminated. The magnetized water is supplied into the detergent container, and thereby the detergent is effectively dissolved by the water.

5 Claims, 8 Drawing Sheets

WASHING MACHINE HAVING A DEVICE FOR APPLYING A MAGNETIC FIELD TO WATER SUPPLIED INTO A DETERGENT CONTAINER

BACKGROUND OF THE INVENTION

1. Field of the Invention

This application claims priority under 35 U.S.C. §§119 and/or 365 to Patent Application No. 98-7069 filed in Korea on Mar. 4, 1998; and Patent Application No. 98-7503 filed in Korea on Mar. 6, 1998; the entire content of which is hereby incorporated by reference.

The present invention relates to a washing machine, and more particularly, to a washing machine capable of effectively dissolving the detergent by magnetizing the water to be supplied into a detergent container.

2. Prior Art

FIGS. 7 and 8 show a conventional washing machine. The washing machine has an outer tub 107 suspended by a suspension 105 in a casing 101, a rotatable washing tub 109 installed in the outer tub 107, a pulsator 111 installed on the bottom of the washing tub 109, a driving motor 117 for rotating the washing tub 109 and/or the pulsator 111, a gear assembly 113 for transmitting the driving force of the driving motor 117 to the washing tub 109 and/or the pulsator 111, and a belt 115 for connecting the driving motor 117 with the gear assembly 113.

The upper side of the casing 101 is covered with a top cover 103 having an opening 119 at the central portion thereof. A door 121 for opening/dosing the opening 119 is installed on the top cover 103.

An accommodation section 125 is provided at the upper portion of the casing 101, and a detergent container is installed in the accommodation section 125. Floury detergent is contained in the detergent container 129. Further, a filtering member 160 is installed in the detergent container 129 in order that the detergent in a lump is not supplied into the washing tub 109.

A water supply pipe 123 is installed on the upper part of the accommodation section 125. The detergent in the detergent container 129 is dissolved by the water supplied into the detergent container 129 from the water supply pipe 123, and the water mixed with detergent is supplied into the washing tub 109.

As the pulsator 111 is being rotated by the driving motor 117, the laundry accommodated in the washing tub 109 is washed. When the washing operation is completed, the washing machine performs the dehydrating operation by rotating the washing tub 109 together with the pulsator 111 at high rotational speed. After the dehydrating operation, the rinsing operation is performed. For the rinsing operation, the washing machine supplies water into the washing tub 109 again through the water supply pipe 123, and then operates the pulsator 111.

The water supplied through the water supply pipe 123 contains positive ions such as calcium ion or magnesium ion. Such metallic impurities impede dissolution of the detergent, so the detergent in the detergent container 129 may not be completely dissolved by the water. If the detergent is incompletely dissolved, the efficiency of washing decreases. Furthermore, some detergent which is not dissolved may remain in the detergent container 129. The remaining detergent may be dissolved by the water supplied for the rinsing operation, and then supplied into the washing tub 109. Therefore, the efficiency of rinsing operation may decrease.

SUMMARY OF THE INVENTION

The present invention has been proposed to overcome the above-described problems in the prior art, and accordingly it is the object of the present invention to provide a washing machine capable of effectively dissolving the detergent contained in the detergent container.

To achieve the above object, the present invention provides a washing machine comprising: a washing tub for accommodating laundry; a detergent container for containing a detergent to be supplied into the washing tub; and a means for applying a magnetic field to water to be supplied into the detergent container.

The applying means comprises: a permanent magnet; and a magnet casing for accommodating the permanent magnet and having a water passage part formed on a central portion thereof, through which the water supplied into the detergent container passes. The permanent magnet takes the shape of a ring surrounding the water passage part.

The applying means is installed in the detergent container, and is fixed by a fixing means. The fixing means comprises: a screw part formed on a part of the magnet casing; and a screw assembly part formed on a part of the detergent container, to which the screw part is screwed.

The water is magnetized by the applying means so that the metallic impurities are eliminated. Thus, the efficiency for dissolving the detergent increases, and the efficiency of washing increases. Furthermore, since no detergent remains in the detergent container, the efficiency of rinsing operation increases.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention Will be described in detail with reference to the accompanying drawings.

Figure 1:
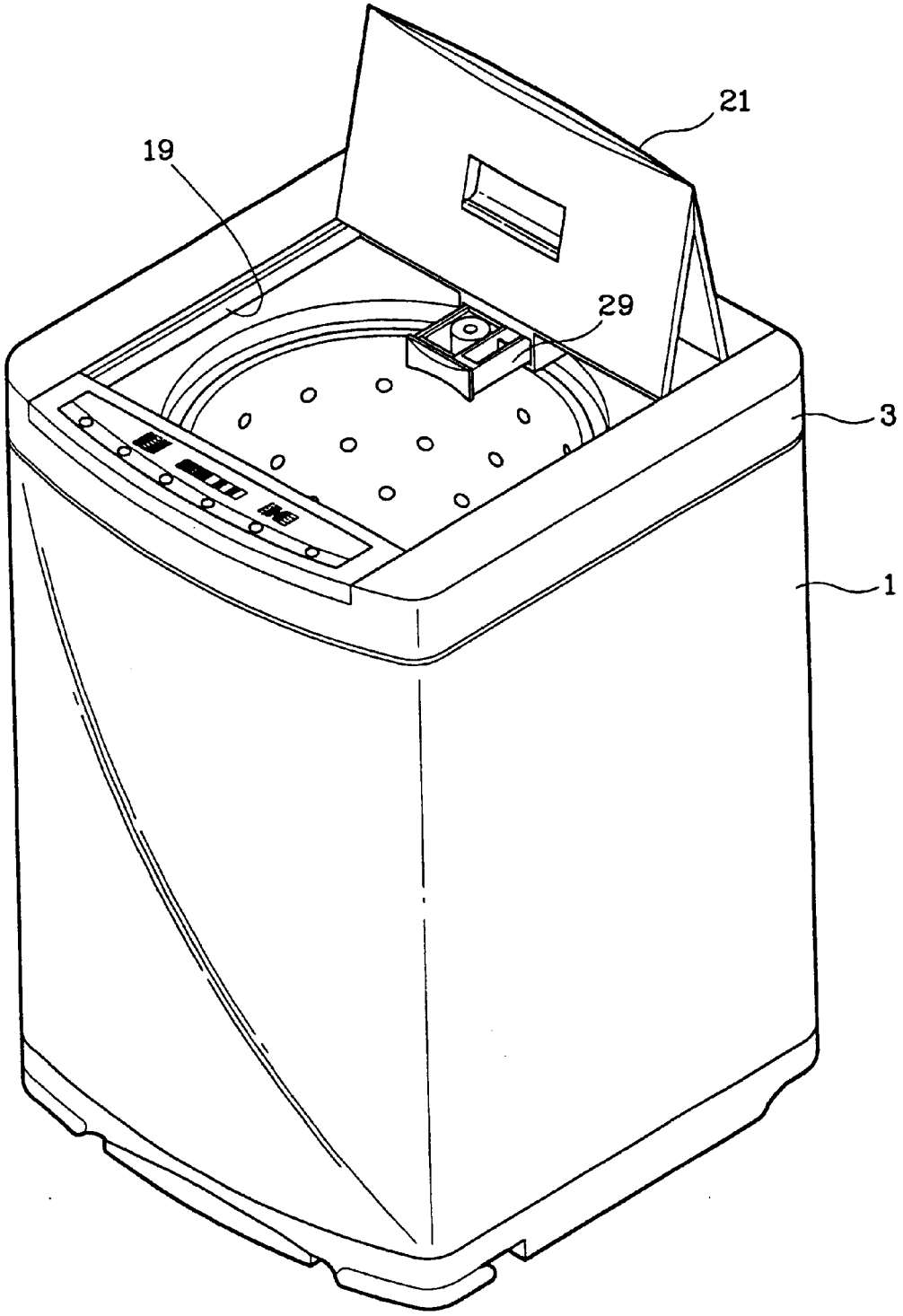
FIG. 1 is a perspective view of a washing machine according to the present invention.
Figure 2:
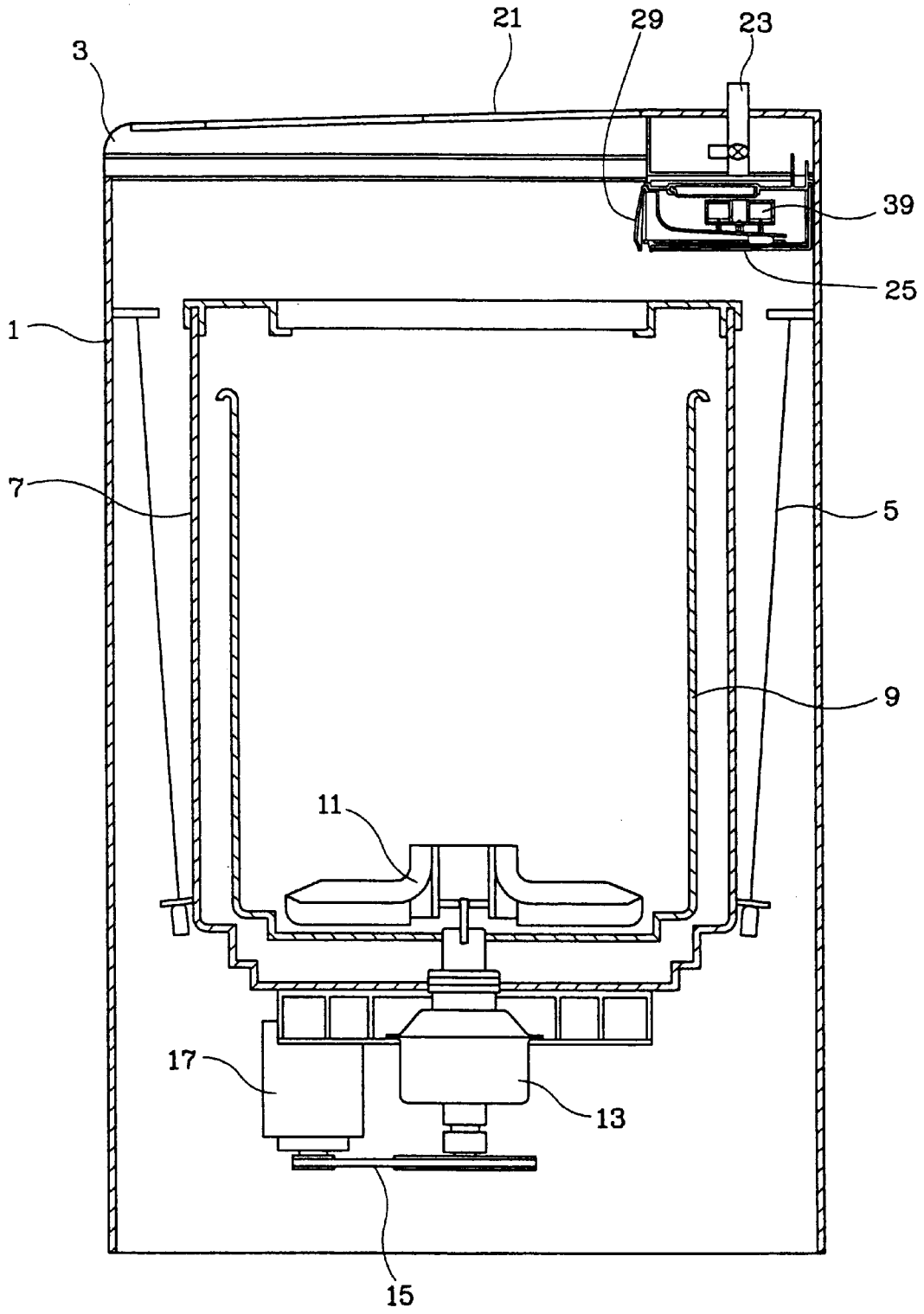
FIG. 2 is a side sectional view of FIG. 1.

FIGS. 1 and 2 show a washing machine according to the present invention. The washing machine according to the present invention has, as a general washing machine, an outer tub 7 suspended by a suspension 5 in a casing 1, a rotatable washing tub 9 installed in the outer tub 7, a pulsator 11 installed on the bottom of the washing tub 9, a driving motor 17 for rotating the washing tub 9 and/or the pulsator 11, a gear assembly 13 for transmitting the driving force of the driving motor 17 to the washing tub 9 and/or the pulsator 11, and a belt 15 for connecting the driving motor 17 with the gear assembly 13.

The upper side of the casing 1 is covered with a top cover 3 having an opening 19 at the central portion thereof. A door 21 for opening/dosing the opening 19 is installed on the top cover 3.

An accommodation section 25 is provided at the upper portion of the casing 1, and a detergent container 29 is installed in the accommodation section 25. The detergent container 29 in the accommodation section 25 is slidable, and therefore, a user can draw the detergent container 29 from the accommodation section 25. Floury detergent is contained in the detergent container 29.

A water supply pipe 23 is installed on the upper part of the accommodation section 25. The accommodation section 25 has a water supply hole 27 as shown in FIG. 3, so that the water can be supplied from the water supply pipe 23 into the detergent container 29.

Figure 3:
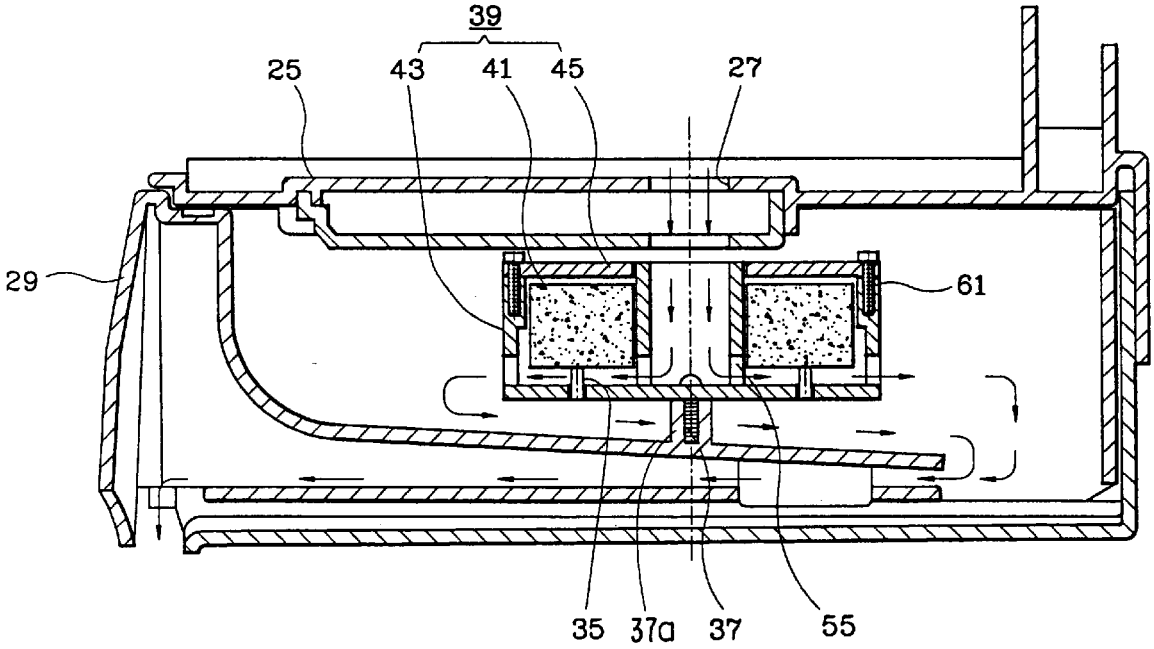
FIG. 3 is a partial enlarged sectional view of FIG. 2.
Figure 4:
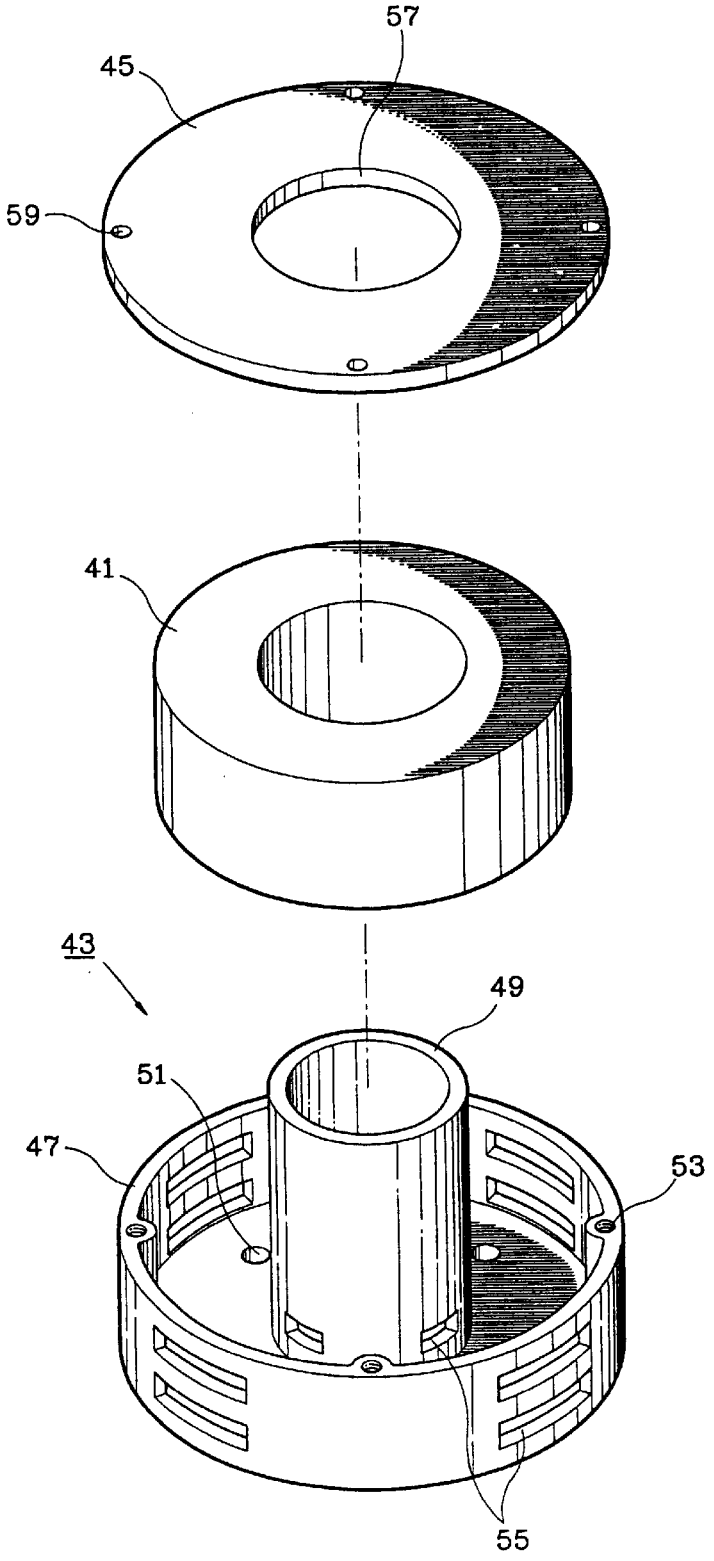
FIG. 4 is an enlarged exploded perspective view of a device for applying a magnetic field to water shown in FIG. 3.

As shown in FIGS. 3 and 4, a magnetizing device 39 is installed in the detergent container 29. The magnetizing device 39 includes a permanent magnet 41, and magnet casings 43, 45. The magnet casing 43, 45 is comprised of a lower casing 43 and an upper casing 45.

The lower casing 43 has a cylindrical water passage part 49 at the central portion thereof, through which the water supplied from the water supply pipe 23 passes. Further, the lower casing 43 has an accommodation part 47 forming a space for accommodating the permanent magnet 41 around the water passage part 49. The permanent magnet 41 takes the shape of a ring surrounding the water passage part 49.

Insertion holes 51 are formed on the bottom side of the lower casing 43, and protrusions 35 are formed on the bottom of the detergent container 29. As the protrusions 35 are inserted into the insertion holes 51, the position of the lower casing 41 is fixed. As, a screw 37 passes through the lower casing 43 and is assembled to a screw assembly part 37*a* formed on the bottom of the detergent container 29, the lower casing 43 is fixed in the detergent container 29.

The upper casing 45 has a central hole 57 through which the water passage part 49 passes, and screw holes 59 corresponding to screw holes 53 formed on the upper edge of the lower casing 43. Screws 61 are assembled to the screw holes 53 passing through the screw holes 59, whereby the upper casing 45 and the lower casing 43 are assembled.

A plurality of discharge holes 55 are formed on the lower area of the water passage part 49 and the side of the accommodation part 47. The water supplied into the water passage part 49 is discharged out of the magnet casing 43, 45 through the discharge holes 55.

Hereinbelow, the operation of the washing machine according to the present invention will be described.

When the washing machine begins to operate, the water is supplied into the magnetizing device 39 installed in the detergent container 29 from the water supply pipe 23 through the water supply hole 27. The water is supplied into the water passage part 49, and a magnetic field formed by the permanent magnet 41 is then applied to the water while the water is passing through the water passage part 49. Thus, the positive ions contained in the water such as calcium ion and magnesium ion are neutralized, whereby the metallic impurities in the water are eliminated and the water is activated. Thereafter, the water is discharged out of the magnetizing device 39 through the discharge holes 55.

The discharged water is supplied into the detergent container 29, by which the detergent in the detergent container 29 is dissolved. Since the detergent is dissolved by the magnetized water, the detergent is dissolved more effectively. The water mixed with detergent is discharged out of the detergent container 29 and is supplied into the washing tub 9.

Then, as the pulsator 11 is being rotated by the driving motor 17, the laundry accommodated in the washing tub 9 is washed. After the washing operation is completed, the dehydrating operation and the rinsing operation are performed.

As described above, since the detergent is effectively dissolved by the activated water, the efficiency of washing operation increases. Furthermore, since no detergent dissolved imperfectly remains in the detergent container 29, the water supplied for the rinsing operation does not contain the detergent, and therefore, the efficiency of rinsing operation increases.

Figure 5:
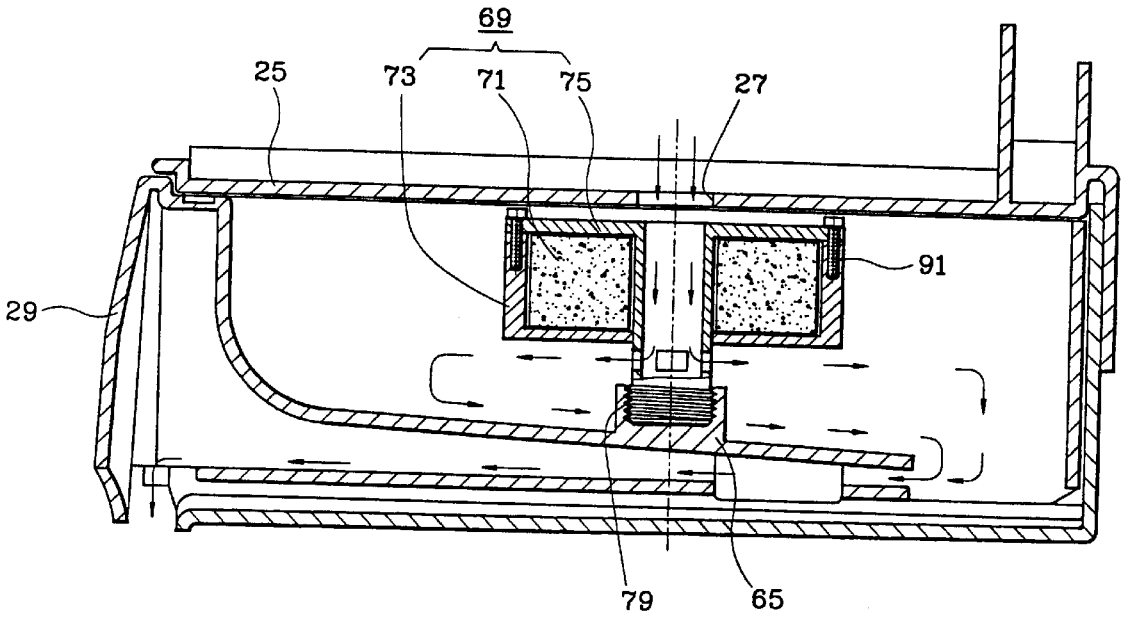
FIG. 5 is another embodiment of the present invention.
Figure 6:
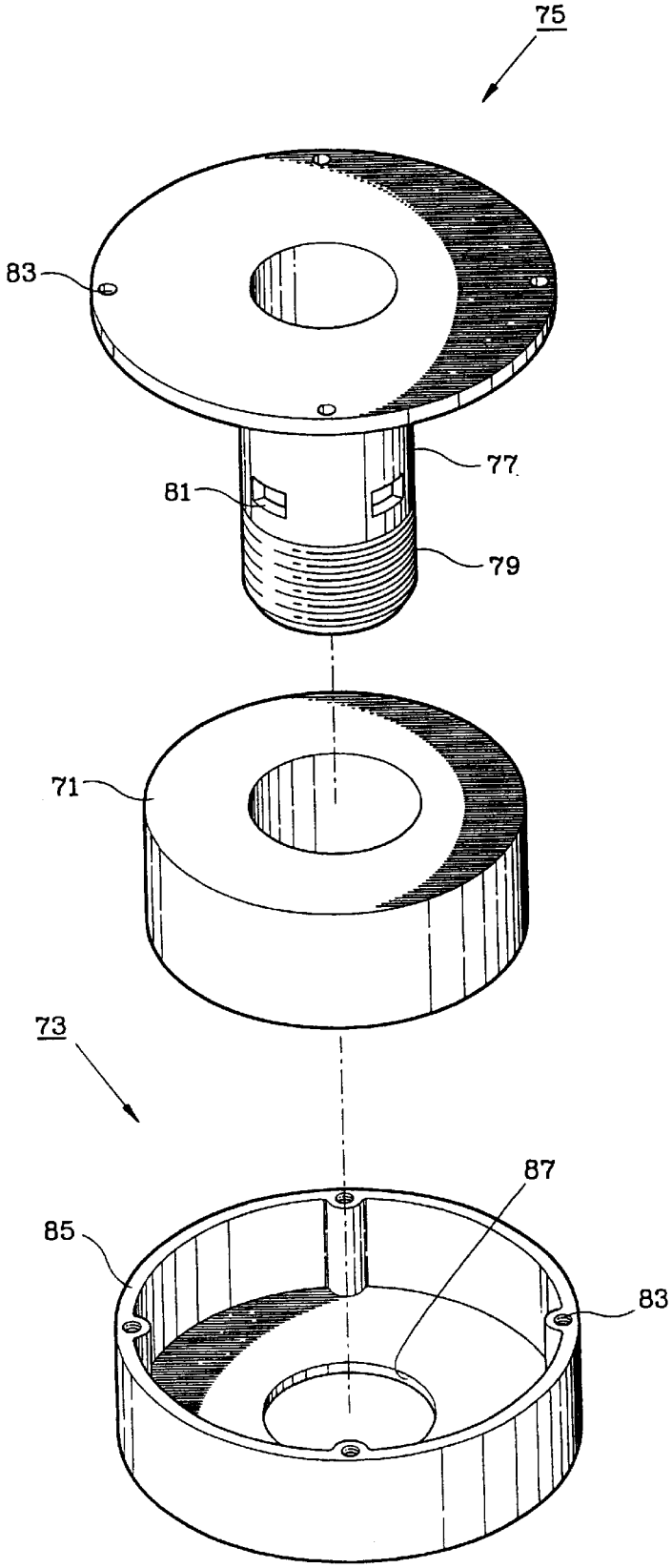
FIG. 6 is an enlarged exploded perspective view of a device for applying a magnetic field to water shown in FIG. 5.
Figure 7:
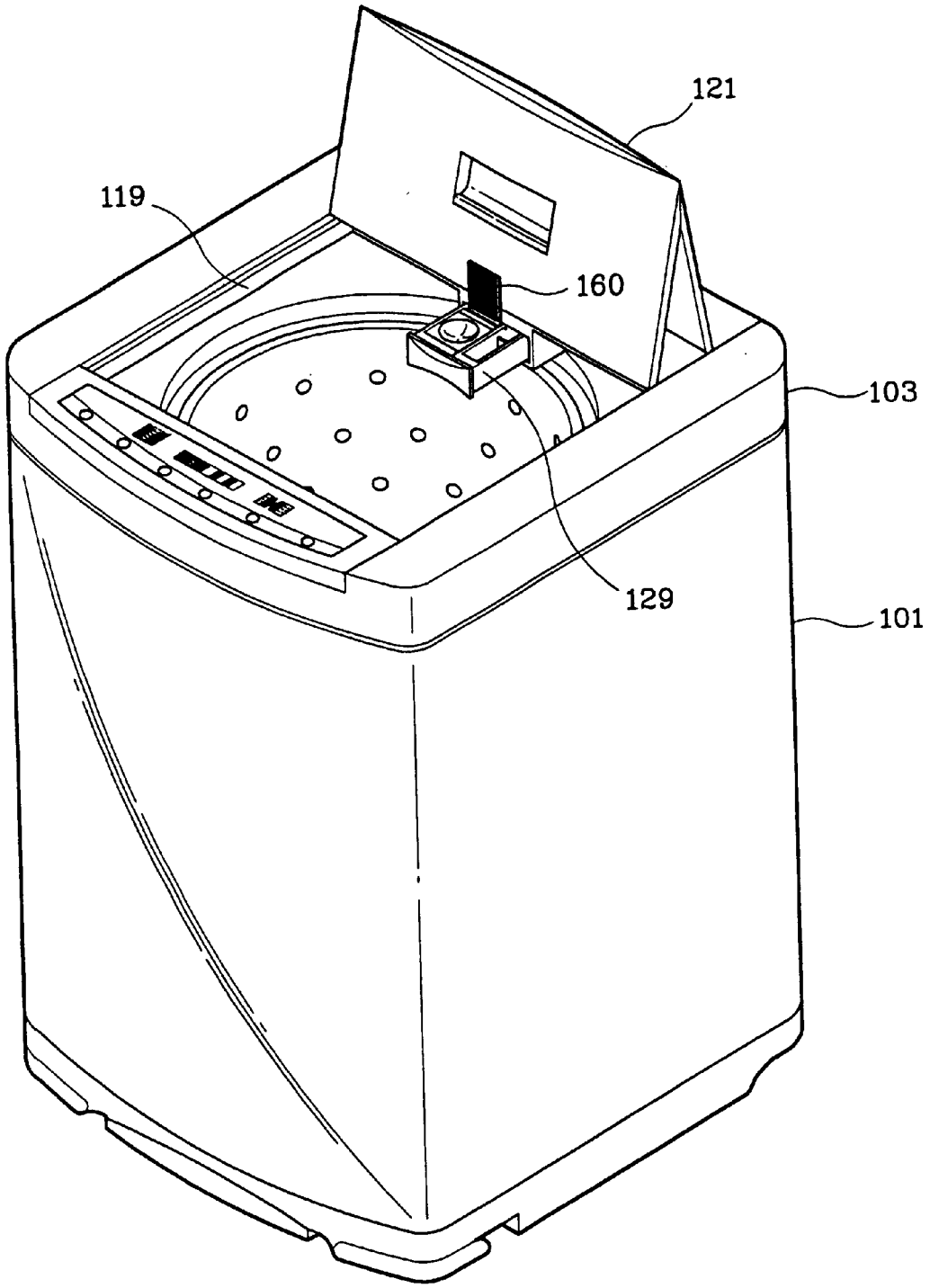
FIG . 7 (PRIOR ART)
FIG. 7 is a perspective view of a conventional washing machine.
Figure 8:
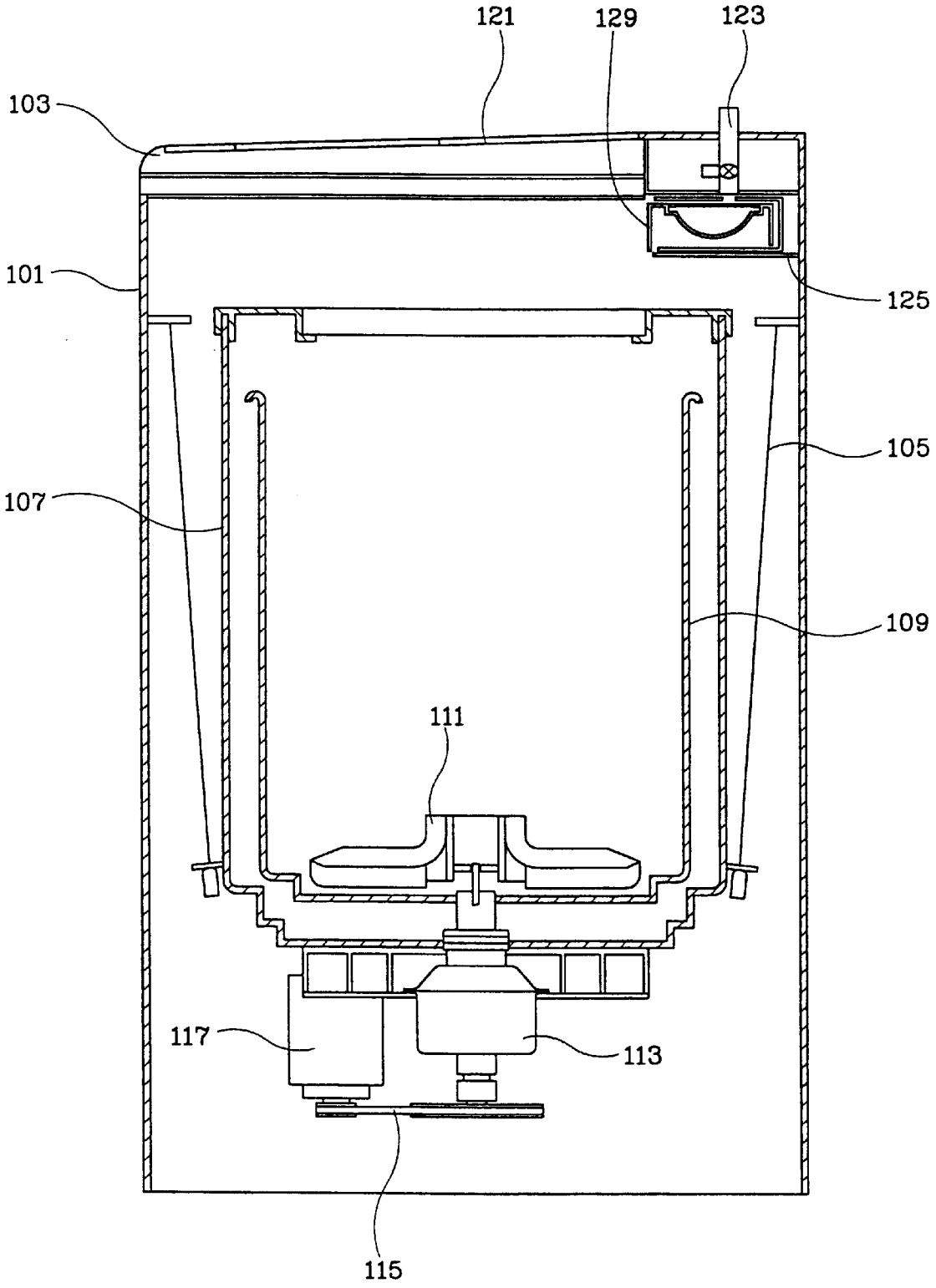
FIG . 8 (PRIOR ART)
FIG. 8 is a side sectional view of FIG. 7.

FIGS. 5 and 6 show another embodiment of the present invention. In the description of the present embodiment, parts substantially identical to those in the above-described embodiment will be referred to with the same reference numerals. In the present embodiment, the accommodation section 25 having a water supply hole 27 and the detergent container 29 accommodated in the accommodation section 25 are substantially the same in construction as that of the above-described embodiment.

In the detergent container 29 is installed a magnetizing device 69 according to the present embodiment. The magnetizing device 69 includes a permanent magnet 71 and a magnet casing 73, 75. The magnet casing 73, 75 is comprised of a lower casing 73 and an upper casing 75.

The lower casing 73 has a cylindrical water passage part 77 at the central portion thereof, through which the water supplied from the water supply pipe 23 passes. The water passage part 77 has discharge holes 81 formed in its side. The water supplied into the water passage part 77 is discharged out of the upper casing 75 through the discharge holes 81. The permanent magnet 71 takes the shape of a ring surrounding the water passage part 77.

The lower casing 73 has an accommodation part 77 forming a space for accommodating the permanent magnet 71. Further, in the center of a lower side of the lower casing 73 is formed a hole 87 through which the water passage part 77 passes.

The upper casing 75 and the lower casing 73 respectively have screw holes 83. As screws 91 are inserted into the screw holes 83, the upper casing 75 and the lower casing 73 are assembled.

A screw part 79 is formed on the lower portion of the water passage part 77, and a screw assembly part 65 assembled with the screw part 79 is formed on the bottom of the detergent container 29. As they are assembled with each other, the magnetizing device 69 is fixed in the detergent container 29.

The water is supplied into the magnetizing device 69 installed in the detergent container 29 from the water supply pipe 23 through the water supply hole 27. The water is supplied into the water passage part 77, and a magnetic field formed by the permanent magnet 71 is applied to the water while the water is passing through the water passage part 77. Thus, the positive ions contained in the water such as calcium ion and magnesium ion are neutralized, whereby the metallic impurities in the water are eliminated and the water is activated. Thereafter, the water is discharged out of the magnetizing device 69 through the discharge holes 81.

The discharged water is supplied into the detergent container 29, whereby the detergent in the detergent container

29 is dissolved. Since the detergent is dissolved by the activated water, the detergent is dissolved more effectively. The water mixed with the detergent is discharged out of the detergent container 29 and is supplied into the washing tub 9.

Then, as the pulsator 11 is rotated by the driving motor 17, the laundry accommodated in the washing tub 9 is washed. After the washing operation has been completed, the dehydrating operation and the rinsing operation are performed. According to the present embodiment, as in the above-described embodiment, the efficiency of washing operation and rinsing operation increase.

According to the present invention, since the detergent is dissolved by the water in which metallic impurities are eliminated by the magnetizing device, the efficiency for dissolving the detergent is enhanced, and thereby the washing operation is effectively performed. Furthermore, since no detergent remains in the detergent container, the efficiency of rinsing operation increases.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A washing machine comprising:

a washing tub for accommodating laundry;

a detergent container for containing a detergent to be supplied into the washing tub; and applying means for applying magnetic field to water supplied into the detergent container, wherein the applying means comprises:

a permanent magnet; and a magnet casing for accommodating the permanent magnet and having a water passage part formed on a central portion thereof through which the water applied into the detergent container passes.

2. The washing machine as claimed in claim 1, wherein the permanent magnet takes the shape of a ring surrounding the water passage part.

3. The washing machine as claimed in claim 1, wherein the magnet casing has a plurality of discharge holes for discharging the water supplied into the water passage part into the detergent container.

4. The washing machine as claimed in claim 1, further comprising a means for fixing the magnet casing to the detergent container.

5. The washing machine as claimed in claim 4, wherein the fixing means comprises:

a screw part formed on a part of the magnet casing; and a screw assembly part formed on a part of the detergent container, to which the screw part is screwed.

* * * * *